US006883440B1

(12) United States Patent
Correia

(10) Patent No.: US 6,883,440 B1
(45) Date of Patent: Apr. 26, 2005

(54) SAFE

(76) Inventor: Lewis A. Correia, 513 S. Nevada St., Oceanside, CA (US) 92054

( * ) Notice: Subject to any disclaimer, the term of this patent is extended or adjusted under 35 U.S.C. 154(b) by 0 days.

(21) Appl. No.: 10/750,343

(22) Filed: Dec. 31, 2003

(51) Int. Cl.[7] ..... E05G 1/04

(52) U.S. Cl. ..... 109/59 R; 109/59 T; 109/74; 70/1.5; 312/217

(58) Field of Search ..... 109/59 R, 74, 109/59 T, 60, 24.1; 312/215–217; 70/109, 1.5, 417, 418

(56) References Cited

U.S. PATENT DOCUMENTS 662,789 A 11/1900 Hollar et al.
1,970,178 A 8/1934 Michlun
2,819,692 A * 1/1958 Johnson et al. ..... 109/50
2,829,021 A * 4/1958 Wolters ..... 312/218
3,175,873 A * 3/1965 Blomquist et al. ..... 312/296
3,315,622 A * 4/1967 Cornaro ..... 109/59 R
3,774,985 A * 11/1973 Chovanec et al. ..... 312/217
4,108,087 A 8/1978 Sebesta
4,123,978 A 11/1978 Lentini
4,192,535 A 3/1980 Picard
4,193,353 A 3/1980 Hinton et al.
4,266,488 A * 5/1981 Markham ..... 109/59 R
4,348,967 A * 9/1982 Schattner et al. ..... 109/51
4,370,935 A 2/1983 Link
4,474,116 A 10/1984 Castenada, Jr. et al.
4,548,330 A * 10/1985 Hewitt et al. ..... 220/210
4,706,577 A * 11/1987 Jones ..... 109/59 T
5,209,168 A * 5/1993 Chapron et al. ..... 109/59 T
5,280,755 A * 1/1994 Batur ..... 109/59 R
5,503,440 A * 4/1996 Peccoux ..... 292/158
5,702,167 A * 12/1997 Muller ..... 312/221
5,778,708 A * 7/1998 Crosby et al. ..... 70/118
5,784,973 A 7/1998 Mercer et al.
5,805,074 A * 9/1998 Warren et al. ..... 340/5.54
5,871,263 A * 2/1999 Johnston et al. ..... 312/217
6,089,168 A 7/2000 Dunlap et al.
6,293,207 B1 * 9/2001 Do ..... 109/59 R
6,334,278 B1 * 1/2002 Arnold ..... 52/79.1
6,561,604 B1 * 5/2003 Leccia et al. ..... 312/326
6,679,087 B1 * 1/2004 Suggs et al. ..... 70/153
6,705,136 B1 * 3/2004 Porter ..... 70/210

* cited by examiner

*Primary Examiner*—Suzanne Dino Barrett
(74) *Attorney, Agent, or Firm*—Calif Tervo

(57) ABSTRACT

Safe 10 has a firmly secured door 60 and latching and locking mechanisms on the frame 30 rather than on door 60. Door opening side 160 includes fingers 66 with catches 68. A movable latch plate 72 includes a plurality of openings 75 for receiving and retaining fingers 66. A locking mechanism 80 includes a main bolt 81 for locking latch plate 72, a first lock 90 actuated through frame 30 for locking main bolt 81, and a second lock 95, preferably actuated remotely, for locking main bolt 81. The latch and locking mechanisms do not operate through door 60 such that the front of door 60 may be featureless. Safe 10 is adapted for mounting in a wall 100 to framing 110, such as to studs 140.

21 Claims, 3 Drawing Sheets

SAFE

FIELD OF THE INVENTION

This invention relates in general to a safe, and more specifically involves a safe having the locking mechanism on the frame and a door having a featureless front.

BACKGROUND OF THE INVENTION

Safes protect valuables. In choosing a safe, there are trade-offs regarding cost, convenience, space and degree of protection offered. Conventional safes offering a high degree of protection from unauthorized entry have the locking mechanism in the door. If the depth of the safe is limited, such as by location space, then a conventional door locking mechanism occupies much of the space available for the safe and limits the amount of storage space within the safe. Additionally, some degree of safety is obtained if it is not obvious that a safe is a safe. For example, home burglars will often overlook a safe that is camouflaged in some manner so as to not look like a safe. However, a door locking mechanism, such as a large combination dial, on the front of a door is a dead giveaway that the enclosure is a safe. Smaller safes, such as for the home, have very weak latch and lock mechanisms. Such safes can often be broken into by cutting a single member or by defeating a single lock.

Therefore, there has been a need for a safe that offers advantages over the prior art.

DETAILED DESCRIPTION OF THE INVENTION

Figure 1:
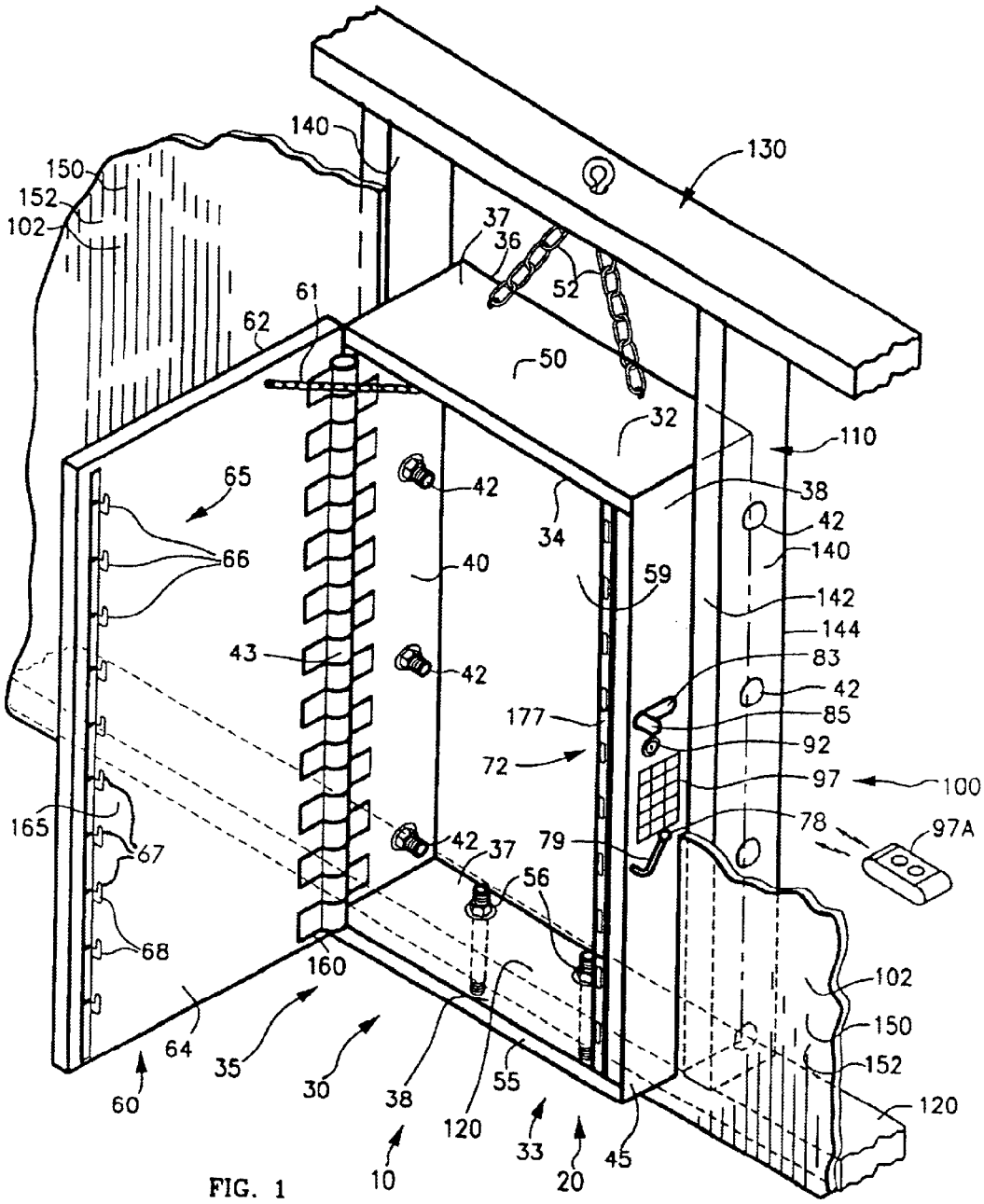
FIG. 1 is a front, top, right side perspective view, partially cut away, of a preferred embodiment of the safe of the invention mounted in a wall.
Figure 2:
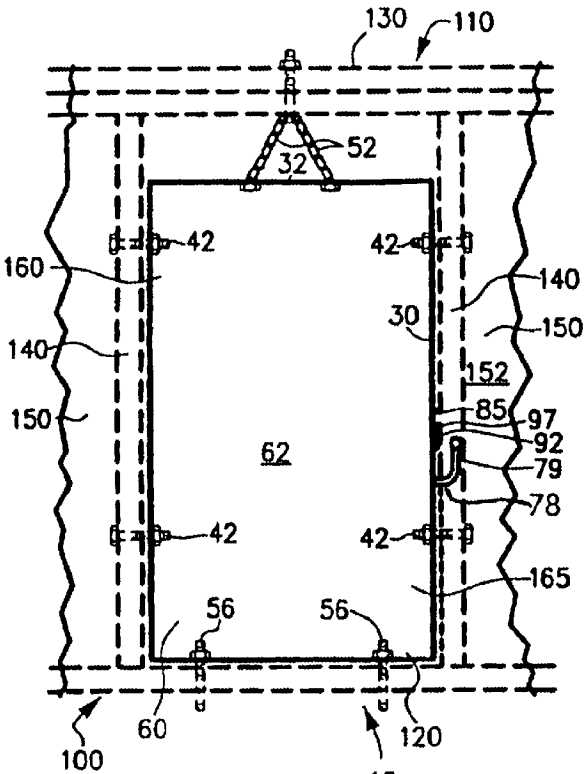
FIG. 2 is a front elevation view of the safe and wall of FIG. 1.

With reference now to FIGS. 1 and 2 of the drawing, there is shown in FIG. 1 a front, top, right side perspective view, partially cut away, of a preferred embodiment of the safe 10 of the invention mounted in a wall 100 and in FIG. 2 a front elevation view of the safe 10 and wall 100 of FIG. 1.

Wall 100 is a typical wall, such as of a home, and includes framing 10 including footer 120 at the foot of wall 100, a header 130 at the top of wall 100 and spaced vertical studs 140 having a bottom connected to footer 120 and a top connected to header 130. Studs 140 have a front 142 and a back 144 and a thickness therebetween. Wall framing 110 comprises strong structural members. Studs 140 are typically 2×4s or 2×6s having a thickness of about four inches to six inches. Studs 140 are typically spaced on sixteen inch centers. A common wall height is eight feet. A covering 150, such as dry wall, paneling, or boards; attached the front of wall framing 10, has a front surface 152 that defines the front 102 of wall 100.

Safe 10 includes an enclosure 20 generally comprising a frame 30 and a door 60. In the exemplary embodiment shown, frame 30 is rectangular and includes a hinge side wall 40, a latch side wall 45, a top wall 50 and a bottom wall 55. Frame 30 may be enclosed in the back by a wall, such as back wall 59. Frame 30 has a top 32, bottom 33, front 34, and back 36. Front 34 of frame 30 has an opening 35 therein; opening 35 being the general opening into safe 10. Preferably, frame 30 has a width equal to the lateral spacing of wall studs 140 and a thickness greater than the thickness of wall studs 140 and preferably greater than the thickness of wall 100. Frame 30 is mounted in wall 100 such that the back portion 37 of frame 30 is retained in wall 100 and the front portion 38 of frame 30 protrudes from front 102 of wall 100. In a preferred embodiment, frame 30 has a depth of seven to eight inches. Frame 30 is made of strong material, such as of thick steel plate.

Frame 10 is secured to wall framing 10. Preferably, frame 30 is dimensioned so as to be readily secured to wall framing 110. Bottom wall 55 is attached to footer 120, floor, or footing by suitable means, such as by fasteners, such as studs 56. Side walls 40, 45 abut wall studs 140 and are attached thereto by suitable means, such as bolts 42. Top wall 50 is secured to header 130 with suitable means, such as chains 52. Preferably, frame 30 is elongate with hinge side wall 40 and latch side wall 45 each having a long length to take advantage of the height of wall 100. Preferably, fasteners 42,56 securing frame 30 to framing 110 are only easily unfastened from within frame 30 such that frame is extremely difficult to detach from framing 110 without access to the inside of frame 30.

Door 60 includes an outer face 62 and an inner face 64. Door hinge side 160 is hingedly attached to frame 30 by hinge 43 that is disposed along substantially the length of hinge side wall 40 such that door 60 swings between closed and open positions. In the closed position, door 60 covers opening 35 of front 34 of frame 30 to form enclosure 20. Hinge 43 is disposed within enclosure 20 so as to be secure when door 60 is closed. Stop means, such as chain 61 connecting door 60 to frame 30, is provided for stopping door 60 from opening past a desired point. Alternatively, door 60 may extend outward past frame hinge side wall 40 such that when door 60 opens, the extended portion encounters hinge side wall 40 and prevents door 60 from opening more than ninety degrees. Other stop means, well-known in the art, could be used.

Figure 5:
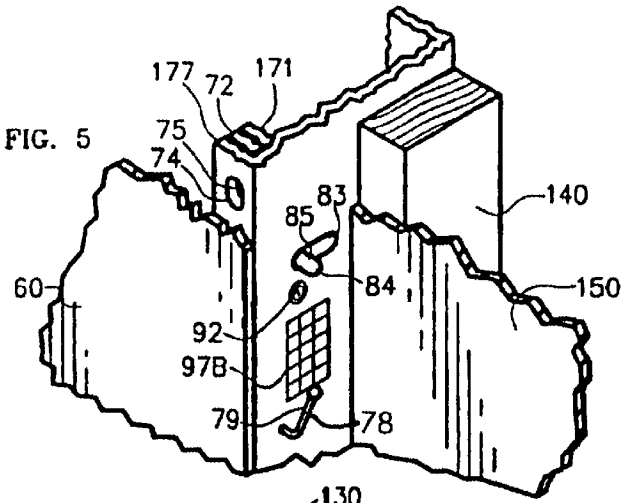
FIG. 5 is a partial, cut-away front, top, right side perspective view of the latching and locking controls of a preferred embodiment.
Figure 3:
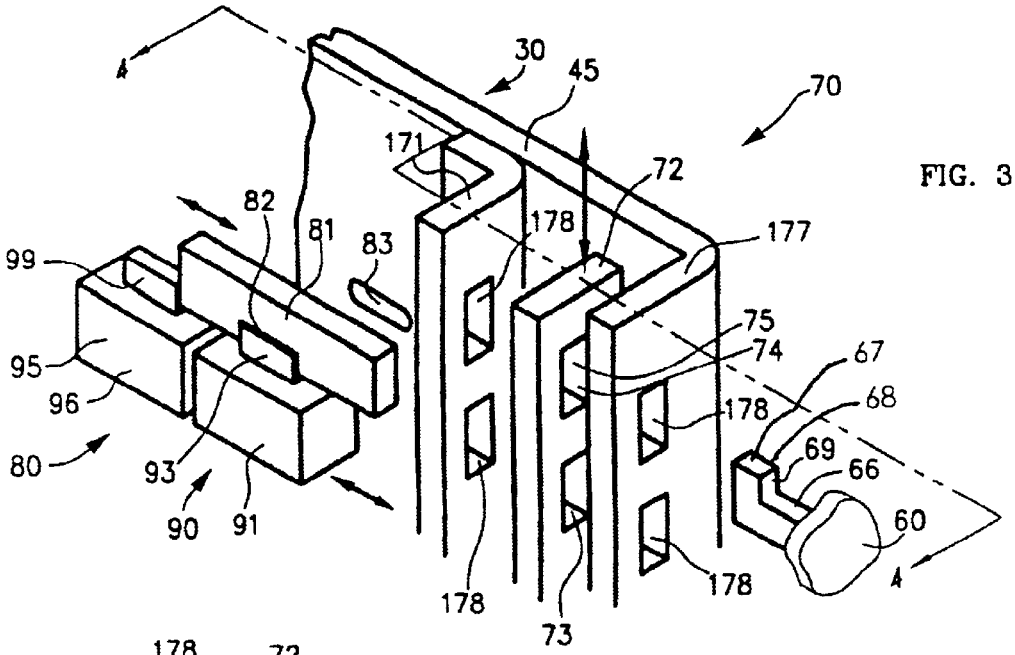
FIG. 3 is a partial front, top, left side perspective view of latching and locking elements of the safe.
Figure 4:
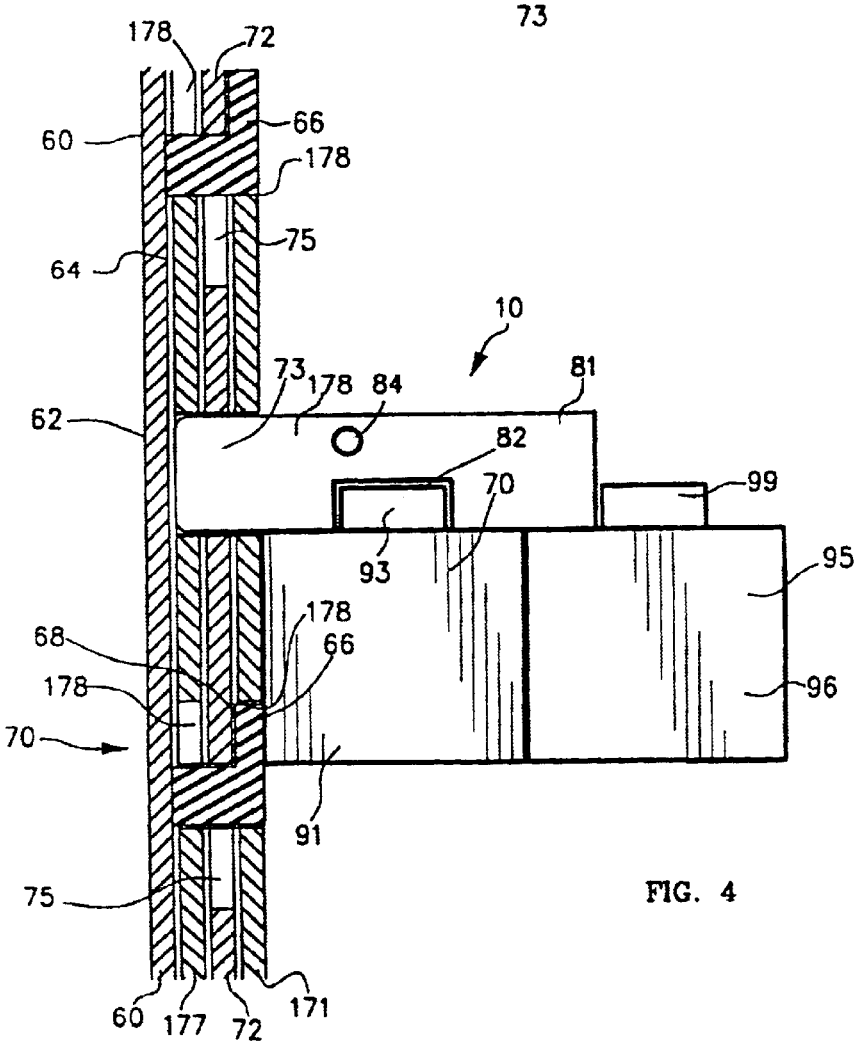
FIG. 4 is partial right side sectional view of the latching and locking elements of the safe taken on line 4—4 of FIG. 3.

Further including FIGS. 3, 4, and 5; FIG. 3 is a partial front, top, left side perspective view of latching and locking elements of safe 10, FIG. 4 is a partial right side sectional view of the latching and locking elements of safe 10 taken on line 4—4 of FIG. 3, and FIG. 5 is a partial, cut-away front, top, right side perspective view of the latching and locking controls of a preferred embodiment.

A latch 70 for holding door 60 in the closed position includes, in general, finger means 65 on door opening side 165, a latch plate 72 connected to frame 30, and latch plate moving means 78.

Finger means 65, such as a plurality of fingers 66, includes catch means 67, such as catches 68 on each finger 66. Fingers 66 project rearward from inner face 64 of door 60 along its opening side 165 such that, with door 60 in the closed position, catches 68 are disposed within enclosure 20 along substantially the length of latch side wall 45. Catches 68 have a front facing surface 69 for engaging latch plate 72.

Latch plate 72 is an elongate vertical steel bar slidingly mounted to frame 30 within enclosure 20 adjacent substantially the length of latch side wall 45 such that it can slide up and down. Latch plate moving means 78, including crank arm 79 actuated from external said enclosure, is connected to latch plate 72 by means well-known in the art and moves latch plate 72 up and down between a latching position and an unlatching position. Latch plate 72 includes engaging means 74, such as openings 75, each for receiving door fingers 66 when door 60 is in the closed position. Latch plate 72 slides up and down between a back latch guide 171 and a front latch guide 177 that are attached to frame 30. Latch guides 171, 177 provide strength to the mounting of latch plate 72 and contain through bores 178 to accommodate fingers 66 and main bolt 81 where necessary.

Latch plate 72 also includes means, such as orifice 73, for engaging main bolt 81. With latch plate 72 in the up, that is in the unlatching position, upon closing door 60, fingers 66 insert into openings 75 such that catch 68 is just to the rear of latch plate 72. Then, moving latch plate 72 to the lower or latching position, such as by gravity or by arm 79, moves the upper end of openings 75 to be in front of catches 68 and front facing surface 69 such that fingers 66 cannot be extracted and door 60 cannot be opened. In this manner, openings 75 engage catches 68 of fingers 66 means along substantially the length of latch side wall 45 such that door 60 cannot open. Although fingers 66 having raised catches 68 are shown and described, the latching means can be accomplished with many with similar mechanisms, such as a single elongate finger having holes for catches or a plurality of fingers having grooves as catches or combinations thereof.

Locking means 80 selectively prevents latch plate 72 from moving to the unlatched position. Locking means 80 generally includes a main bolt 81, a first lock 90, and a second lock 95.

Main bolt 81 is slidingly mounted to frame 30 within enclosure 20 by means, such as a housing connected to frame 30, not shown but well-known in the art. Main bolt 81 is slidable between a forward, locking position wherein the front of main bolt 81 engages orifice 73 of latch plate 72 such that latch plate 72 cannot move to the unlatching position and an rearward, unlocking position wherein the front end of main bolt 81 is not engaged and does not prevent latch plate 72 from moving to the unlatching position. A slot 83 passes though frame 30. Main bolt moving means 84, such as knob 85 accessed from external frame 30 and connected to main bolt 81 thought slot 83, is used for moving main bolt 81 between the locking position and the unlocking position. Preferably, main bolt moving means 84 is rather flimsy such that it will fail before causing other damage if it is used to try to move a locked main bolt 81. Other main bolt moving means 84 are contemplated, such as a remotely actuated solenoid.

First lock 90 includes a main body 91 mounted to frame 30, such as to latch side wall 45, within enclosure 20. First lock 90 includes a bolt 93 and actuation means, such as a remote control 97A or a keyway 92 actuated with a key, for moving bolt 93 between a locking position wherein bolt 93 engages main bolt 81, such as in notch 82 in main bolt 81, such that main bolt 81 cannot move from the locking position, to an unlocked position wherein bolt 93 is retracted and does not prevent main bolt 81 from moving to the unlocked position. First lock 90 may be a rather conventional mechanical lock with a keyway 92 passing through frame 30 for receiving a key.

Second lock 95 may also be a rather conventional lock. Second lock 95 includes a main body 96 mounted to frame 30, such as to latch side wall 45, within enclosure 20. Second lock 95 includes a bolt 99. When actuated, second lock bolt 99 moves between a locking position wherein bolt 99 engages main bolt 81, such as behind back end of main bolt 81, such that main bolt 81 cannot move from the locking position to an unlocked position wherein bolt 99 is retracted and does not prevent main bolt 81 from moving to the unlocked position.

Preferably, second lock 95 is electronic. A preferred embodiment contains circuitry actuated by actuation means, such as a remote control wave source 97A, such as a radio, outside of frame 30 such that the presence of second lock 95 is unknown. In this manner, a thief will be foiled even after defeating first lock 90. Electronic locks of this nature are well-known the art. Alternatively, second lock 95 may be actuated by means outside of frame 30, such as electronic keypad 97B on outer surface of frame 30 and connected by an electric connector through a small hole in enclosure 30 to main body 96 within enclosure 20.

Figure 6:
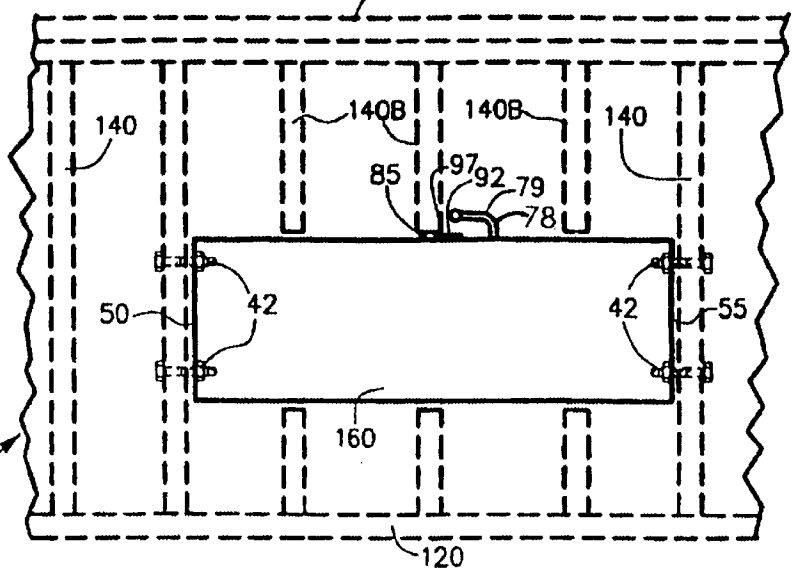
FIG. 6 is a front elevation view of the safe mounted in a horizontal configuration in a wall.

FIG. 6 is a front elevation view of an alternate mounting of safe 10 in a wall. Safe 10 is mounted with longitudinal axis horizontally, preferably such that hinge side wall 40 is on the bottom and latch side wall 45 is on the top. Safe 10 is dimensioned such that end walls 50, 55 may be secured, such as by bolts 42 to wall studs 140. Intermediate wall studs 140B have been cut away to allow for insertion of safe 10 into wall 100. Horizontal safe 10 is actuated in the same manner as vertical safe 10. With horizontal mounting, stop means, such as a chain 61, may hold door 60 such that door 60 acts as a platform when door 60 upon which items can be set.

Now that the invention has been described, it can be seen that it provides a very secure enclosure for valuables. The strong steel door 60 is retained along the entire hinged 160 and opening 165 sides. The hinge 43 is within the safe 10. A plurality of fingers 66 retains the opening side 165 of door 60. These features make it extremely difficult to break into safe 10 by dismantling door 60.

A strong, separate main bolt 81 bolts the latch plate 72. In a preferred embodiment, two separately operated locks 90, 95 lock the main bolt 81. In a preferred embodiment, one of the two locks is unseen and remotely, electronically actuated. Thieves are frustrated and deterred by the unknown locking apparatus.

It should be appreciated that safe 10 of the invention is much more easily camouflaged as a safe than conventional large safes. The front 62 of door 60 is featureless so that it can be covered with a mirror, painting, work area or ornamentation such that safe 10 is not readily recognizable as a safe. The latch and lock activating elements on the frame are more easily hidden.

When safe 10 is inserted in a wall, none of the depth is taken up by locking mechanism, such that safe 10 has much more usable space than conventional door-mounted locks and safe 10 does not protrude unacceptably into the room.

The side locking mechanism of safe 10 and the safe's dimensions allow safe 10 to be mounted in a wall such that it cannot be easily removed. This prevents thieves from removing safe 10 for opening elsewhere.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A safe comprising:

an enclosure including a frame having a top, bottom, front, and back; said front of said frame having an opening therein; said frame including:

a hinge side wall having a length; and a latch side wall opposing said hinge side wall and having a length; and a door movable between closed and open positions including:

an outer face; and an inner face; said inner face in the closed door position for covering said opening of said front of said frame;

a hinge within said enclosure hingedly connecting said door to said hinge side wall for opening and closing said door;

a latch for holding said door in the closed position including:

finger means including:

catch means; said finger means connected to said inner face of said door and projecting rearward such that said catch means is disposed within said enclosure along substantially the length of said latch side wall with said door in the closed position;

a latch plate including:

engaging means; said latch plate mounted to said frame within said enclosure adjacent substantially the length of said latch side wall; said latch plate movable between a latching position wherein said engaging means engages said catch means of said finger means along substantially the length of said latch side wall with said door in the closed position such that said door cannot open and an unlatching position wherein said engaging means does not engage said catch means;

latch plate moving means connected to said latch plate for moving said latch plate between the latching position and the unlatching position; said moving means actuated from external said enclosure; and locking means including:

a main bolt mounted to said frame within said enclosure; said main bolt movable between a locking position wherein said main bolt engages said latch plate in the latching position such that said latch plate cannot move to the unlatching position and an unlocking position wherein said main bolt does not prevent said latch plate from moving to the unlatching position;

main bolt moving means for moving said main bolt between the locking position and the unlocking position with said latch plate remaining in the latching position; said main bolt moving means accessed from external said frame; and a first lock including:

a bolt; and lock actuation means; said first lock mounted to said frame and actuated by said first lock actuation means from external said frame between a locking position wherein said first lock bolt engages said main bolt such that said main bolt cannot move from the locking position to an unlocked position wherein said first lock bolt does not prevent said main bolt from moving to the unlocked position.

2. The safe of claim 1 wherein said first lock is a key lock and said actuation means is a keyway through said frame.

3. The safe of claim 1 wherein said latch plate moving means, said main bolt moving means, and said first lock actuation means act through said latch side wall.

4. The safe of claim 1 further including:

a second lock including:

a bolt; and lock actuation means; said second lock mounted to said frame and actuated by said second lock actuation means from external said frame between a locking position wherein said second lock bolt engages said main bolt such that said main bolt cannot move from the locking position to an unlocked position wherein said second lock bolt does not prevent said main bolt from moving to the unlocked position.

5. The safe of claim 4 wherein said second lock is electronic and actuated by a remote control.

6. The safe of claim 4 wherein said second lock is electronic and actuated by a keypad on the outside of said frame.

7. A wall safe for disposition in a wall; said safe comprising:

an enclosure including a frame having a top, bottom, front, and back and having a back portion for disposition in the wall and a front portion; said front of said frame having an opening therein; said frame including:

securing means for securing said frame in a wall;

a hinge side wall having a length; and a latch side wall opposing said hinge side wall and having a length, and a door movable between closed and open positions including:

an outer face; and an inner face; said inner face in the closed door position for covering said opening of said front of said frame;

a hinge within said enclosure hingedly connecting said door to said hinge side wall for opening and closing said door;

a latch for holding said door in the closed position including:

finger means including:

catch means; said finger means connected to said inner face of said door and projecting rearward such that said catch means is disposed within said enclosure along substantially the length of said latch side wall with said door in the closed position;

a latch plate including:

engaging means; said latch plate mounted to said frame within said enclosure adjacent substantially the length of said latch side wall; said latch plate movable between a latching position wherein said engaging means engages said catch means of said finger means along substantially the length of said latch side wall with said door in the closed position such that said door cannot open and an unlatching position wherein said engaging means does not engage said catch means;

latch plate moving means for moving said latch plate between the latching position and the unlatching position; said moving means actuated from external said enclosure; and locking means including:

a main bolt mounted to said frame within said enclosure; said main bolt movable between a locking position wherein said main bolt engages said latch plate in the latching position such that said latch plate cannot move to the unlatching position and an unlocking position wherein said main bolt does not prevent said latch plate from moving to the unlatching position;

main bolt moving means for moving said main bolt between the locking position and the unlocking position with said latch plate remaining in the latching position; said main bolt moving means accessed from external said frame; and a first lock including:

a bolt; and actuation means; said first lock mounted to said frame and actuated by said actuation means from external said frame between a locking position wherein said first lock bolt engages said main bolt such that said main bolt cannot move from the locking position to an unlocked position wherein said first lock bolt does not prevent said main bolt from moving to the unlocked position.

8. The safe of claim 7 wherein said first lock is a key lock and said actuation means is a keyway through said frame.

9. The safe of claim 7 wherein said latch plate moving means, said main bolt moving means, and said first lock actuation means act through said latch side wall.

10. The safe of claim 7 further including:

a second lock including:

a bolt; and lock actuation means; said second lock mounted to said frame and actuated by said second lock actuation means from external said frame between a locking position wherein said second lock bolt engages said main bolt such that said main bolt cannot move from the locking position to an unlocked position wherein said second lock bolt does not prevent said main bolt from moving to the unlocked position.

11. The safe of claim 10 wherein said second lock is electronic and actuated by a remote control.

12. The safe of claim 10 wherein said second lock is electronic and actuated by a keypad on the outside of said frame.

13. In combination:

a wall having a front including:

framing including:

a pair of spaced wall studs;

a wall safe comprising:

an enclosure including a frame having a top, bottom, front, and back and a width equal to the lateral spacing of said wall studs, and having a back portion retained in said wall; said front of said frame having an opening therein; said frame including a hinge side wall having a length; and a latch side wall opposing said hinge side wall and having a length; and a door movable between closed and open positions including:

an outer face; and an inner face; said inner face in the closed door position for covering said opening of said front of said frame;

securing means securing said wall safe to said wall framing;

a hinge within said enclosure hingedly connecting said door to said hinge side wall for opening and closing said door;

a latch for holding said door in the closed position including:

finger means including:

catch means; said finger means connected to said inner face of said door and projecting rearward such that said catch means is disposed within said enclosure along substantially the length of said latch side wall with said door in the closed position;

a latch plate including:

engaging means, said latch plate mounted to said frame within said enclosure adjacent substantially the length of said latch side wall; said latch plate movable between a latching position wherein said engaging means engages said catch means of said finger means along substantially the length of said latch side wall with said door in the closed position such that said door cannot open and an unlatching position wherein said engaging means does not engage said catch means;

latch plate moving means for moving said latch plate between the latching position and the unlatching position; said moving means actuated from external said enclosure; and locking means including:

a main bolt mounted to said frame within said enclosure; said main bolt movable between a locking position wherein said main bolt engages said latch plate in the latching position such that said latch plate cannot move to the unlatching position and an unlocking position wherein said main bolt does not prevent said latch plate from moving to the unlatching position;

main bolt moving means for moving said main bolt between the locking position and the unlocking position with said latch plate remaining in the latching position; said main bolt moving means accessed from external said frame; and a first lock including:

a bolt; and actuation means; said first lock mounted to said frame and actuated by said actuation means from external said frame between a locking position wherein said first lock bolt engages said main bolt such that said main bolt cannot move from the locking position to an unlocked position wherein said first lock bolt does not prevent said main bolt from moving to the unlocked position.

14. The combination of claim 13 wherein said latch plate moving means, said main bolt moving means, and said first lock actuation means act through said latch side wall.

15. The combination of claim 13 further including:

a second lock including:

a bolt; and lock actuation means; said second lock mounted to said frame and actuated by said second lock actuation means from external said frame between a locking position wherein said second lock bolt engages said main bolt such that said main bolt cannot move from the locking position to an unlocked position wherein said second lock bolt does not prevent said main bolt from moving to the unlocked position.

16. The combination of claim 15 wherein said second lock is electronic; and wherein said latch plate moving means, said main bolt moving means, and said first lock actuation means act through said latch side wall.

17. The combination of claim 15 wherein said second lock is electronic and actuated by a remote control.

18. The combination of claim 15 wherein said second lock is electronic and actuated by a keypad on the outside of said frame.

19. The combination of claim 13 wherein said hinge side wall and said latch side wall are horizontal.

20. The combination of claim 13 wherein said hinge side wall is below said latch side wall.

21. The safe of claim 1 wherein said first lock is a mechanical lock and said actuation means operates through said frame.

* * * * *